US005991577A

United States Patent [19]

Liu et al.

[11] Patent Number: 5,991,577

[45] Date of Patent: Nov. 23, 1999

[54] AIR BREAKDOWN CHARGE AND DEVELOPMENT IMAGE FORMING METHOD AND APPARATUS USING IMAGE AREA CENTERED PATCHES OF TONER

[75] Inventors: Chu-Heng Liu, Penfield; Weizhong Zhao, Webster, both of N.Y.

[73] Assignee: Xerox Corporation, Stamford, Conn.

[21] Appl. No.: 09/197,753

[22] Filed: Nov. 23, 1998

[51] Int. Cl.[6] ..... G03G 15/02

[52] U.S. Cl. ..... 399/169; 399/237

[58] Field of Search ..... 399/127, 128, 399/237, 296, 169, 183

[56] References Cited

U.S. PATENT DOCUMENTS

| | | | |
|---|---|---|---|
| 4,504,138 | 3/1985 | Kuehnle et al. . | |
| 5,387,760 | 2/1995 | Miyazawa et al. . | |
| 5,436,706 | 7/1995 | Landa et al. . | |
| 5,563,688 | 10/1996 | Bergen et al. | 399/169 |
| 5,619,313 | 4/1997 | Domoto et al. | 399/233 |
| 5,826,147 | 10/1998 | Liu et al. | 399/237 |

*Primary Examiner*—Matthew S. Smith
*Assistant Examiner*—Greg Moldafsky
*Attorney, Agent, or Firm*—Tallam I. Nguti

[57] ABSTRACT

A method and apparatus for producing high quality liquid toner images in an electrostatic printing machine. The method using the apparatus includes selectively coat a photoreceptor only in selected image area centered portion of the photoreceptor surface thereby forming an image area centered patch of toner with developing material; image-wise exposing each such portion; patch of toner. The method using the apparatus next includes forming a final toner image from each image area centered patch of toner using an air breakdown charge development (ABCD) assembly. The ABCD assembly includes a relatively large magnitude voltage biasing source, and a nip forming roll coupled thereto and forming a toner solids recharging nip with the photoreceptor, for image-wise recharging of the single polarity toner solids coating each image area centered patch of toner, by inducing an air breakdown electrical discharge in which free mobile ions are introduced into the vicinity of each image area centered patch of toner. The latent image underlying each image area centered patch of toner cooperates with the large magnitude voltage biasing source to cause free mobile ions to flow to the toner solids of each image area centered patch of toner in an image-wise manner corresponding to the underlying latent image. This, in turn, leads to image-wise recharging of the toner solids of each image area centered patch of toner in which toner solids in image areas of each patch then have a first polarity, and toner solids in background areas thereof then have a second and relatively opposite polarity. The method of the present invention then includes separating the image area toner solids of each patch of toner from the background area toner solids thereof, thereby resulting in an efficiently produced, quality toner image with significantly reduced non-development marking material generated and requiring removal.

8 Claims, 5 Drawing Sheets

FIG. 2
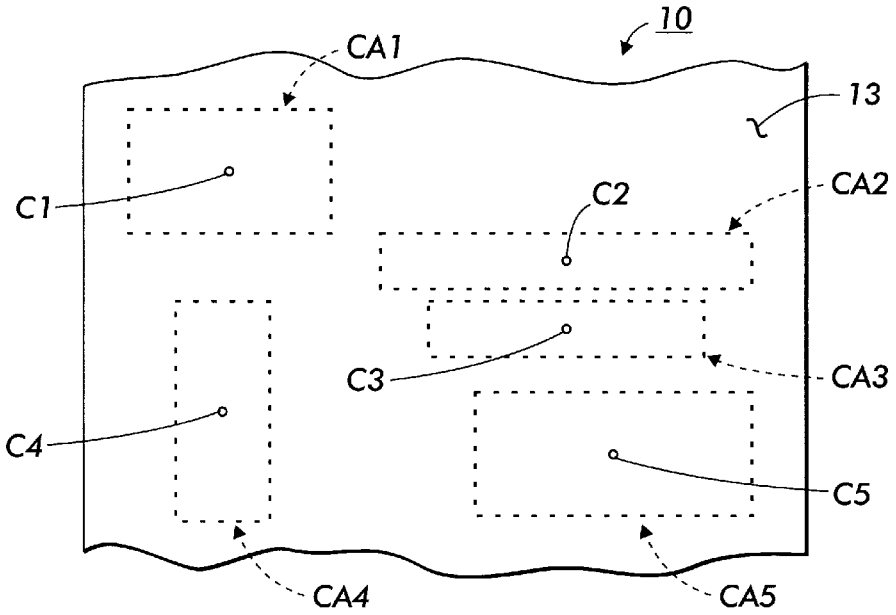
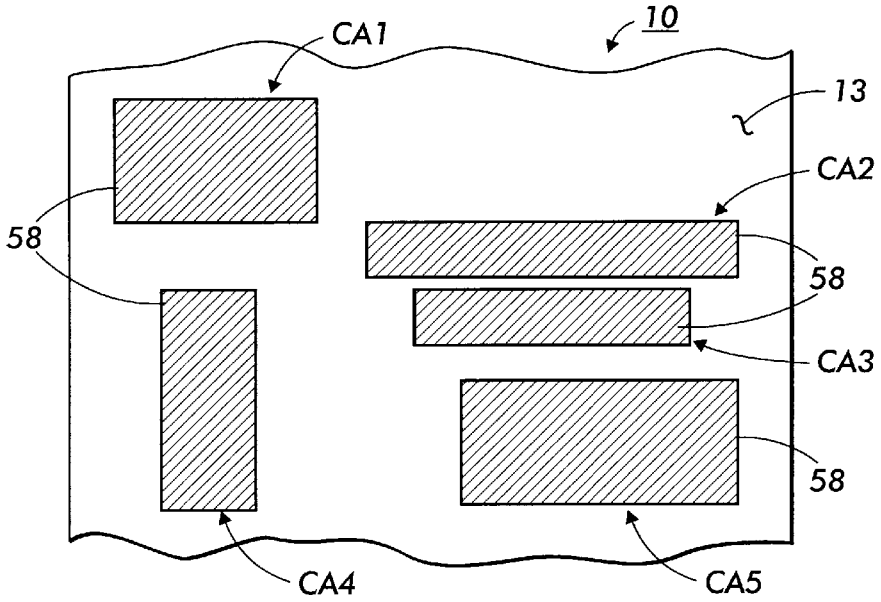
FIG. 3

AIR BREAKDOWN CHARGE AND DEVELOPMENT IMAGE FORMING METHOD AND APPARATUS USING IMAGE AREA CENTERED PATCHES OF TONER

RELATED CASES

This application is related to U.S. application Ser. No. 09/197,785 (Applicants' Docket NO. D/97345) entitled "IMAGE FORMING REVERSE CHARGE PRINTING METHOD AND APPARATUS USING IMAGE AREA CENTERED PATCHES OF TONER" filed on even date herewith; and U.S. application Ser. No. 09/197,753 (Applicants' Docket NO. D/97345Q1) entitled "CONTACT ELECTROSTATIC PRINTING IMAGE FORMING METHOD AND APPARATUS USING IMAGE AREA CENTERED PATCHES OF TONER" filed on even date herewith; and each having at least one common inventor.

BACKGROUND OF THE INVENTION

This invention relates generally to electrostatographic image forming methods, and more particularly, concerns an air breakdown charge and development (ABCD) contact electrostatic toner image forming apparatus and method for efficiently forming and developing an electrostatic latent image from an image area centered patch of developer material or toner coated on selectively charged portions of a photoreceptor. The method and apparatus advantageously diminish the quantity of non-development toner being handled by the machine during latent image development, and thus increases the efficiency of the machine as well as the quality of toner images formed.

Generally, processes for electrostatographic copying and printing are initiated by uniformly charging and selectively discharging a charge receptive photoreceptor in accordance with an original input document or an imaging signal, generating an electrostatic latent image on the photoreceptor. This latent image is subsequently developed into a visible image by a process in which charged developing material or toner solids are deposited onto the surface of the latent photoreceptor, wherein charged toner solids or particles in the developing material adhere to image areas of the latent image.

The developing material typically comprises carrier granules having marking or toner particles adhering triboelectrically thereto, wherein the toner particles are electrostatically attracted from the carrier granules to the latent image areas to create a powder toner image on the photoreceptor. Alternatively, the developing material may comprise a liquid developing material comprising a carrier liquid having pigmented marking particles (or so-called toner solids) and charge director materials dispersed and/or dissolved therein (so-called liquid toner), wherein the liquid developing material is applied to the latent image bearing photoreceptor with the marking particles being attracted to the image areas of the latent image to form a developed liquid image.

Regardless of the type of developing material employed, the toner or marking particles of the developing material are uniformly charged and electrostatically attracted to the latent image to form a visible developed image corresponding to the latent image on the photoreceptor. The developed image is subsequently transferred, either directly or indirectly, from the photoreceptor to a copy substrate, such as paper or the like, to produce a "hard copy" output document. In a final step, the photoreceptor is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface. It will be understood that the instant invention applies to all various types of electrostatic printing systems and is not intended to be limited by the manner in which the image is formed on the photoreceptor or the nature of the photoreceptor itself.

As described hereinabove, the typical electrostatographic printing process includes uniformly charging the entire surface of the photoreceptor, image-wise exposing the entire surface, and physically transporting developing material including charged marking or toner particles into contact with the photoreceptor so as to selectively develop the latent image areas thereon in an image-wise configuration. Development of the latent image is usually accomplished by electrostatic attraction of charged toner or marking particles to the image areas of the latent image.

The development process is most effectively accomplished when the particles carry electrical charges opposite in polarity to the latent image charges, with the amount of toner or marking particles attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

Numerous and various alternative methods of developing a latent image have been described in the art of electrophotographic printing and copying. Of particular interest with respect to the present invention is the concept of forming on a surface, a thin layer of liquid developing material having a high concentration of charged marking particles, with the layer being acted upon by image-wise forces, and being separated into image and background portions. For the purposes of the present description, the concept of latent image development via direct surface-to-surface transfer of a toner layer via image-wise forces will be identified generally as Contact Electrostatic Printing (CEP). Air Breakdown Charge and Development (ABCD), is one variant of CEP, wherein a thin layer of liquid developer material is recharged using an air breakdown charging device, into opposite charge polarities in the image and background areas, which are thereafter separated. Because of the relatively large fraction of toner mass traditionally left in the background areas, cleaning and reuse of such toner from the background areas ordinarily can detrimentally affect the efficiency of the overall printing system.

The following sample references may be relevant as background art for the present invention. For example, U.S. Pat. No. 4,504,138 discloses a method of forming a latent electrostatic image on a uniformly charged surface, and developing the latent electrostatic image by applying a thin viscous layer of electrically charged toner particles to the electrostatic latent image. The apparatus includes an applicator roller mounted for rotation in a container for toner suspension, an electrode arranged adjacent the circumferential surface of the roller to define an electrodeposition chamber therebetween, and electrical connections between the roller, the electrode and a voltage source to enable electrolytic separation of toner particles in the chamber, thus forming a thin highly viscous layer of concentrated toner particles on the roller.

U.S. Pat. No. 5,387,760 discloses a wet development apparatus for use in a recording machine to develop a toner image corresponding to an electrostatic latent image on a uniformly charged electrostatic latent image carrying member or carrier. The apparatus includes a development roller disposed in contact with or near the electrostatic latent image carrier and an application head for applying a uniform layer of wet developer material to the roller.

U.S. Pat. No. 5,436,706 discloses an imaging apparatus including a first member having a first uniformly charged surface having formed thereon a latent electrostatic image, wherein the latent electrostatic image includes image regions at a first voltage and background regions at a second voltage. A second member charged to a third voltage intermediate the first and second voltages is also provided, having a second surface adapted for resilient engagement with the first surface. A third member is provided, adapted for resilient contact with the second surface in a transfer region. The imaging apparatus also includes an apparatus for supplying liquid toner to the transfer region thereby forming on the second surface a thin layer of liquid toner containing a relatively high concentration of charged toner particles, as well as an apparatus for developing the latent image by selectively transferring portions of the layer of liquid toner from the second surface to the first surface.

U.S. Pat. No. 5,619,313 discloses a method and apparatus for simultaneously developing and transferring a liquid toner image. The method includes the steps of moving a photoreceptor including a charge bearing surface having a first electrical potential, uniformly applying a layer of charge having a second electrical potential onto the charge bearing surface, and image-wise dissipating charge from portions on the charge bearing surface to form a latent image electrostatically, such that the charge-dissipated portions of the charge bearing surface have the first electrical potential of the charge bearing surface. The method also includes the steps of moving an intermediate transfer member biased to a third electrical potential that lies between said first and said second potentials, into a nip forming relationship with the moving photoreceptor to form a process nip. The method further includes the step of introducing charged liquid toner having a fourth electrical potential into the process nip, such that the liquid toner sandwiched within the nip simultaneously develops image portions of the latent image onto the intermediate transfer member, and background portions of the latent image onto the charge bearing surface of the photoreceptor.

In each of the sample types of references, the toner layer is formed or developed uniformly. After the development, the toner materials in the areas that correspond to the background need to be fully recovered in order to be used for subsequent development processes. In addition, in each of the sample applications, the photoreceptor is typically charged uniformly, meaning that the entire surface of the photoreceptor is charged. Subsequently, non-image or background areas, for example, are then discharged in order to prevent them from being developed with non-image developing toner, along with image areas. In each of these references, image quality and inefficiency of the method and apparatus are therefore concerns. Image quality for example is a concern because it may vary significantly due to numerous conditions affecting latent image formation as well as latent image development. In particular, image development can be affected by charge levels, both in the latent image, as well as in the developing material. For example, when the charge on dry toner particles becomes significantly depleted, binding forces with the carrier also become depleted, causing an undesirable increase in image development, which, in turn, causes the development of the latent image to spread beyond the area defined thereby.

Inefficiency in an image forming method and apparatus is impacted significantly, for example, by the quantity or volume of non-development or unused charged toner material that is applied to the photoreceptor and moved through the development nip. Such non-development charged toner can undesirably affect charge levels of cooperating elements, and of course has to be removed or cleaned subsequently from the photoreceptor in order to ready the photoreceptor for recharging and reuse. Such cleaning or removal efforts involve inefficiencies in themselves, and it is of course time consuming and costly to recycle or dispose of such non-development or unused charged toner after it has been applied to the photoreceptor, and moved through the development nip.

SUMMARY OF THE INVENTION

In accordance with one aspect of the present invention, there is provided an efficient toner image forming method wherein a quantity of unused toner applied to a photoreceptor of a machine is significantly diminished. To start, only selective scattered portions of a surface of a photoreceptor (and not the entire surface) are charged. Each selected portion of the scattered portions is preferably centered relative to, and has an area that slightly exceeds an image area or area to be imaged. A layer of marking material or toner is coated onto each selected portion thereby forming an "image area centered patch of toner" (IACP), or "image area centered patch of marking material or toner particles". Each selected portion is then image-wise exposed to form a first latent image. Subsequently each image area centered patch of toner is recharged by an air breakdown charging assembly that includes a relatively large magnitude voltage biasing source and a nip forming roll coupled thereto. The air breakdown charging assembly induces an air breakdown electrical discharge wherein free mobile ions are introduced into a vicinity of each image area centered patch of toner. The latent image underlying each image area centered patch of toner cooperates with the large magnitude voltage biasing source to cause the ionized free mobile ions to flow to toner solids in an image-wise manner, thereby image-wise recharging such toner solids such that toner solids in image areas of each patch then have a first polarity, and toner solids in background areas thereof then have a second and relatively opposite polarity. The method then includes a step of separating the image area toner solids having the first polarity from the background area toner solids having the second polarity, and of transferring the image area toner solids onto a copy substrate, thereby resulting in an efficiently produced, quality toner image with significantly reduced non-development marking material generated and requiring removal.

In accordance with another aspect of the present invention, there is provided a liquid toner printing machine for efficiently forming toner images such that a quantity of unused toner applied to a photoreceptor of the machine is significantly diminished. The machine includes a movable photoreceptor having a photoconductive surface for supporting electrostatic charge; a controller and a first charging device connected to the controller for selectively charging only scattered portions of the surface of the photoreceptor, wherein each selected scattered portion is centered relative to, and has an area slightly exceeding an area of the surface to be imaged; a liquid developer material supply and application apparatus for applying a coat of charged toner solids having a single polarity onto the selectively charged scattered portions of the photoreceptor, thereby forming an image area centered patch of toner on each such portion; an exposure device for image-wise exposing each image area centered patch of toner to form a first latent image in the patch of toner; and an air breakdown charge and development (ABCD) assembly for developing each exposed image area centered patch of toner. The air breakdown assembly includes a relatively large magnitude voltage biasing source and a nip forming roll coupled thereto, for image-wise recharging of toner solids in each of the image area centered patches of toner. The air breakdown charging assembly induces an air breakdown electrical discharge wherein free mobile ions are introduced into a vicinity of each image area centered patch of toner, and the latent image underlying each image area centered patch of toner cooperates with the large magnitude voltage biasing source to cause free mobile ions to flow to the toner solids in an image-wise manner, thereby image-wise recharging such toner solids such that toner solids in image areas of each patch then have a first polarity, and toner solids in background areas thereof then have a second and relatively opposite polarity. A biased separator member is then provided for separating the toner solids in image areas from the toner solids in background areas, thereby resulting in an efficiently produced, quality toner image with significantly reduced non-development marking material generated and requiring removal.

BRIEF DESCRIPTION OF THE DRAWINGS

These and other aspects of the present invention will become apparent from the following description in conjunction with the accompanying drawings in which:

FIG. 2 is an illustration of scattered image area centered portions of the surface of the photoreceptor of the machine of FIG. 1, charged by a first charging device in accordance with the present invention;

FIG. 3 is an illustration of the scattered image area centered portions of the surface of the photoreceptor of the machine of FIG. 1, showing toner coated thereon to form Image Area Centered Patches of toner in accordance with the present invention;

DETAILED DESCRIPTION OF THE INVENTION

While the present invention will be described in terms of an illustrative embodiment, it will be understood that the invention is adaptable to a variety of copying and printing applications, and is not necessarily limited to the particular embodiment shown and described herein. On the contrary, the following description is intended to cover all alternatives, modifications, and equivalents, as may be included within the spirit and scope of the invention as defined by the appended claims.

Figure 1:
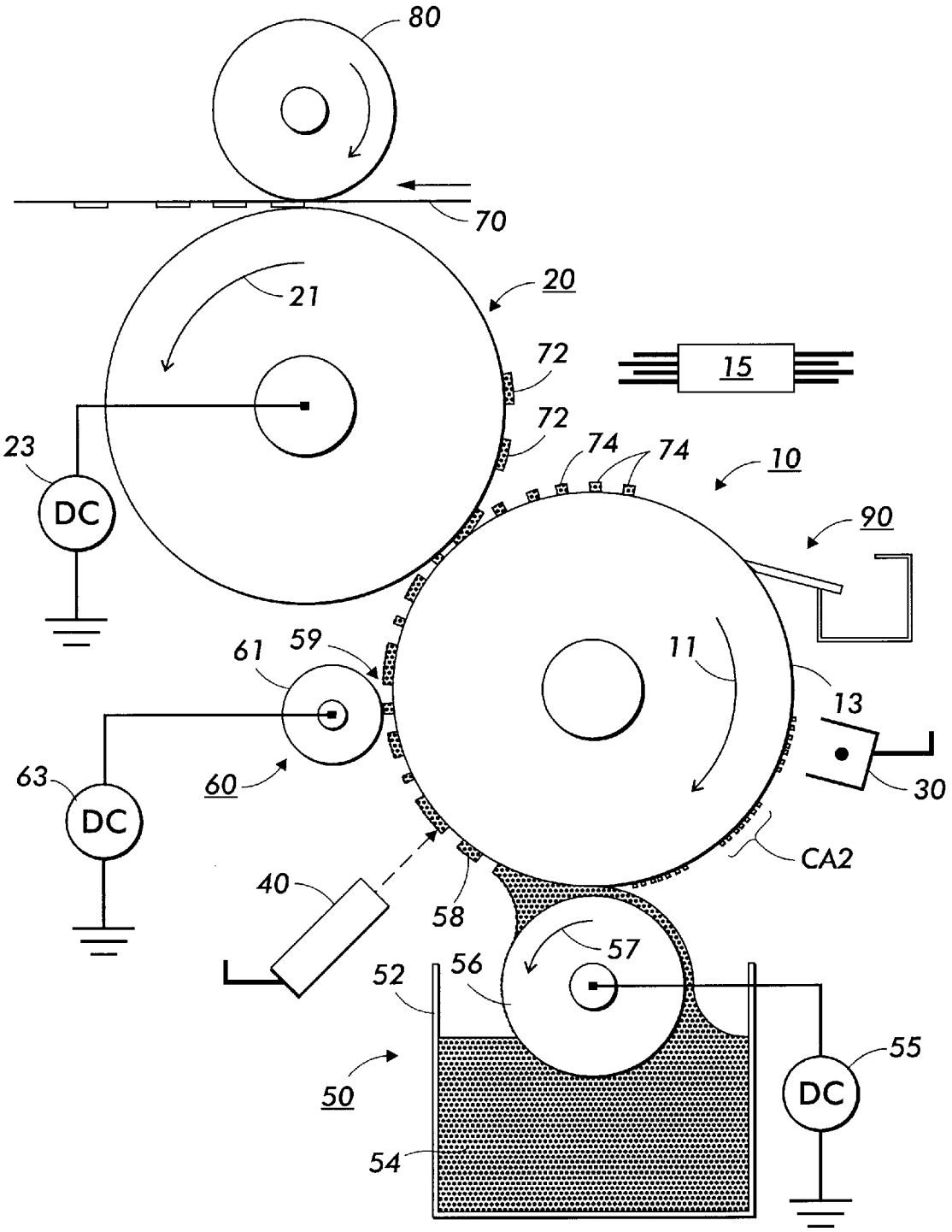
FIG. 1 is a simple schematic illustration depicting a liquid printing machine such as a liquid immersion development (LID) machine, for forming toner images using image area centered patches of toner in accordance with the present invention.

Referring now to FIGS. 1 and 2, a liquid printing machine and parts thereof, capable of forming toner images in accordance with the present invention are illustrated. As shown, the machine includes an assemblage of operatively associated image forming and control elements, including an photoreceptor 10, and an electronic control subsystem or controller 15 for controlling the operations of various elements of the machine.

Photoreceptor 10 includes an imaging surface 13 of any type capable of supporting electrostatic charges and an electrostatic latent image formed thereon. Although the following description will be directed by example to a system and process incorporating a photoconductive photoreceptor, it will be understood that the present invention contemplates the use of various alternative embodiments for a photoreceptor as are well known in the art of electrostatographic printing, including, for example, but not limited to, non-photosensitive photoreceptors such as a dielectric charge retaining member of the type used in ionographic printing machines, or electroded substructures capable of generating charged latent images.

Photoreceptor 10 is rotated, as indicated by arrow 11, so as to transport the surface 13 thereof in a process direction for implementing a series of image forming steps in accordance with the method of the present invention. Initially, the photoconductive surface 13 is moved through a charging station, which is shown including a corona generating first charging device 30. Importantly, the first charging device 30 is connected to the controller 15 for further enabling it to apply electrostatic charge to scattered selective portions shown in FIG. 2 as CA1, CA2, CA3, CA4, and CA5, of the surface 13 of the photoreceptor 10. FIG. 2 is an illustration of scattered image area centered portions, of the surface 13 of the photoreceptor 10, that have been charged by the first charging device 30 in accordance with the present invention. The corona generating first charging device 30 preferably is capable of charging such each selective portion of the photoconductive surface to a relatively high potential.

Importantly too, each such charged scattered selective portion CA1, CA2, CA3, CA4, and CA5 is centered on, or has a common center C1, C2, C3, C4 and C5, respectively with a corresponding area of the surface 13, which (as pre-determined by the controller 15), is to be imaged in subsequent steps. Such pre-determination can be based on information or image data about a finished toner image sheet or page for which a particular section or image frame of the surface 13 is being processed.

Referring now to FIGS. 1 and 3, the surface 13 of the photoreceptor 10 with the charged scattered selective portions CA1, CA2, CA3, CA4, and CA5 thereon, is then advanced to a toner solids coating station that includes a toner supply and coating apparatus 50. In accordance with an aspect of the present invention, the apparatus 50 supplies and applies a thin coat of charged marking or toner particles to each charged scattered selective portions CA1, CA2, CA3, CA4, and CA5, thus producing a scattered or non-uniform pattern of image area centered patches of toner solids 58 (FIG. 3) on the surface 13 of the photoreceptor 10.

As further shown in FIG. 1, the toner supply and applicator apparatus 50 includes a housing 52 that is adapted to accommodate a supply of toner particles 54 and any additional carrier material, if necessary. The apparatus 50 also includes an applicator roller 56 which is rotated in a direction as indicated by arrow 57 to transport toner from housing 52 into contact with the surface of the photoreceptor 10, onto which it forms a toner solids coat onto each charged scattered selective portions CA1, CA2, CA3 CA4, and CA5, thus producing a scattered or non-uniform pattern of image area centered patches of toner "cake" or toner solids 58 (FIG. 3) on the surface 13 of the photoreceptor 10.

The toner "cake" or toner solids coat 58 described above can be created in various ways. For example, depending on the materials utilized in the printing process, as well as other process parameters such as process speed and the like, a coating of toner particles having sufficient thickness, preferably on the order of between 2 and 15 microns and more preferably between 3 and 8 microns, may be formed on the surface of the photoreceptor 10 by employing electrical biasing to assist in actively moving the charged toner particles or solids from the applicator 56 onto the latent image portions of the surface of the photoreceptor 10. Therefore, the applicator roller 56 is preferably coupled to an electrical biasing source 55 for implementing a so-called forward biasing scheme, wherein the toner applicator 56 is provided with an electrical bias of magnitude sufficient to create electrical fields extending from the toner applicator roll 56 to the selected latent image portions on the surface of the photoreceptor 10, thus creating the toner "cake" or toner solids coat 58 described above.

Figure 4:
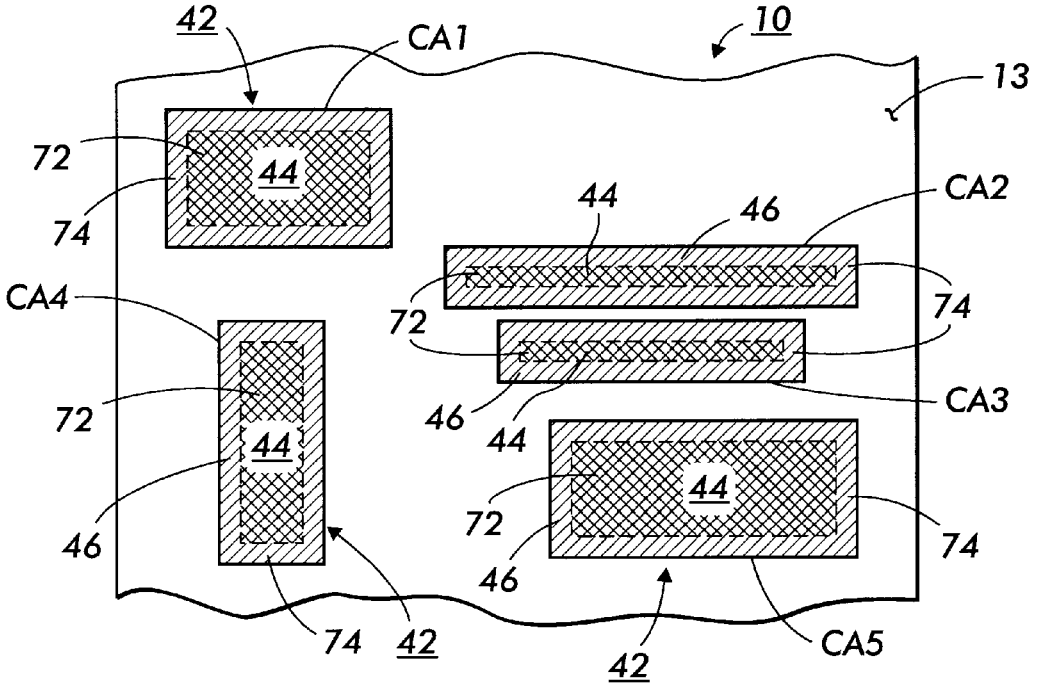
FIG. 4 is an illustration of the charged and coated scattered image area centered portions of the surface of the photoreceptor of the machine of FIG. 1, being image-wise exposed in accordance with the present invention.

Referring now to FIGS. 1 and 4, the machine 8 then includes an exposure device 40 that is connected to the controller 15 for image-wise exposing each charged scattered selective portion CA1, CA2, CA3, CA4, and CA5 to form a first latent image 42 having image areas 44 and background areas 46. The surface 13 of the photoreceptor 10 with the charged scattered selective portion CA1, CA2, CA3, CA4, and CA5 thereon is then advanced to the exposure device 40 which projects a light image onto each such portion corresponding to an input image to be reproduced thereon. In the case of an imaging system having a photosensitive photoreceptor, as currently described, the light image projected onto the charged and coated scattered selective portions CA1, CA2, CA3, CA4, and CA5 of the surface 13, selectively dissipates charges in sections thereon for recording the first electrostatic latent image 42 on each such portion. Each such first electrostatic latent image 42 thus comprises an image area 44 defined by a first charge voltage, and a background area 46 defined by a second charge voltage.

Figure 5:
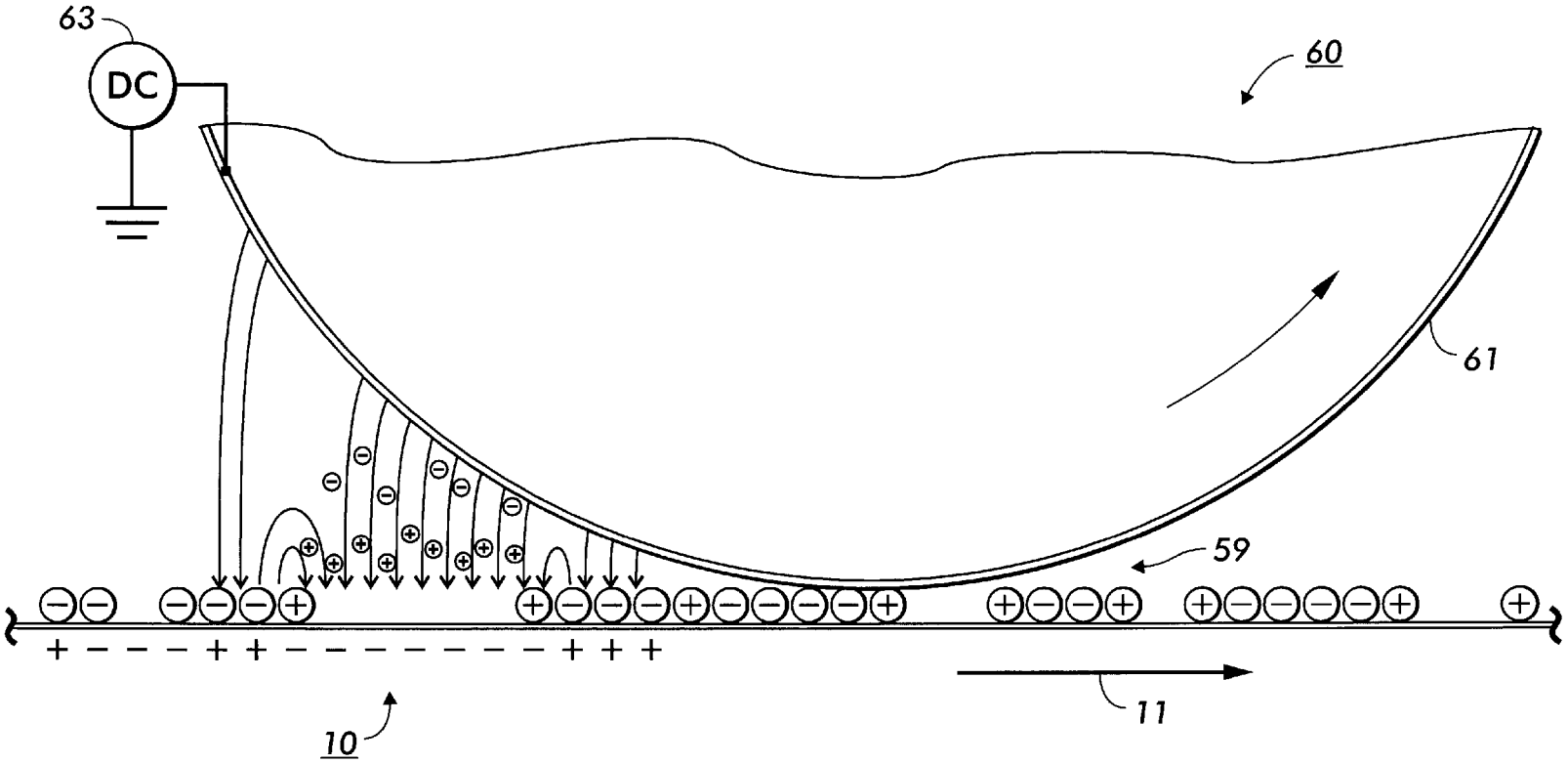
FIG. 5 is an exploded view illustrating image-wise recharging of the image area centered patches of toner of FIG. 4 by an air breakdown charge development (ABCD) assembly in accordance with an aspect the present invention.

Referring now to FIGS. 1 and 5, after the image area centered patches of toner or "cakes" 58 and the latent image are formed as above, an air breakdown charge development (ABCD) assembly 60 is employed for forming a final toner image from each patch. ABCD (Air Breakdown Charge Development) method and apparatus used as a primary process for forming a toner image are disclosed for example in U.S. application Ser. No. 08/884,236, filed Jun. 27, 1997 in the name of the current inventors, (relevant parts of which are incorporated herein by reference). As disclosed therein, ABCD employs uniform photoreceptor surface charging, latent image formation, uniform, none image-wise coating of the entire photoreceptor surface with toner solids forming, air breakdown biasing and image-wise recharging of the toner solids, and image-wise separation of image area toner solids from background area toner solids to form a desired toner image. In the present invention, each image area centered patch of toner or "cake" 58 is used in place of a uniform toner solids layer, and the ABCD method and apparatus are used to develop a toner image from the latent image and the patches of toner.

Referring still to FIGS. 1 and 5, the air breakdown charge development (ABCD) assembly 60 comprises a relatively high air breakdown bias source 63 coupled to a nip forming roll 61 which is shown forming a toner image recharging nip 59 with the photoreceptor surface 13. The ABCD assembly 60 advantageously provides for better voltage control. The polarity of the air breakdown bias source 63 preferably should be relatively opposite that of the original toner charge. The value of the bias source 63 should be set high enough in order to cause air breakdown at the entrance into the nip 59 only between the biased roll 61 and such background areas, as such background areas enter the toner image refining nip 59. Because of the relatively small voltage between the source 63 and the image area, there is advantageously no air breakdown between the biased roll 61 and toner solids 72 in image areas 44, as such image areas 44 enter the toner image recharging nip 59. Such image-wise air breakdown (in background areas 46 but not in image areas 44) causes a reversal of the polarity of the charge on toner solids 74 in the background areas 46, and thus enables their efficient separation from the toner solids 72 in the image areas 44.

Thus, once each image area centered patch of toner or "cake" 58 is image-wise recharged by the ABCD assembly 60, the photoreceptor 10 is advanced to an image separator 20 which forms an image transfer nip 62 with the photoreceptor 10, and rotates as shown by arrow 21. Image separator 20 may be provided in the form of a biased roll member having a surface adjacent to the surface of the photoreceptor 10 and preferably contacting the recharged image area centered patches of toner or "cakes" 58 residing on photoreceptor 10. An electrical biasing source 23 is coupled to the image separator 20 to bias the image separator 20 so as to attract either image area toner solids 72 or background area toner solids 74 of the recharged image area centered patches of toner or "cakes" 58, thereby simultaneously separating each image area centered patch of toner or "cake" 58 into a final toner image 72' consisting of image area toner solids 72 on one surface, and background area toner solids 74 on the other surface.

In the embodiment of FIG. 1, the image separator 20 is biased with a polarity opposite the charge polarity of the image area toner solids 72 in each image area centered patch of toner or "cake" 58, so as to enable it to attract such image area toner solids 72 from the photoreceptor 10, resulting in a final toner image 72' made up of such selectively separated and transferred toner solids 72. The significantly reduced or diminished background image byproduct, toner solids 74, are thus left on the surface of the photoreceptor 10 for removal by a cleaning unit 90. Alternatively, the image separator 20 can be provided with an electrical bias having a polarity appropriate for attracting background area toner solids 74 away from the photoreceptor 10, thus maintaining image area toner solids 72 corresponding to the final toner image 72' on the surface of the separator 20.

In another preferred embodiment, the ABCD assembly in FIG. 1 is removed and its functionality is incorporated into the separation roll. In this embodiment, a single nip accomplishes both ABCD toner image recharging and image/ background separation with two separate function achieved at the nip entrance and exit respectively. A biased toner image separator was brought into nip contact with the patches of toner with a latent image underneath. Air breakdown occurred between the positively biased substrate and the negatively charged background areas, reversing the polarity of charge on toner solids in these background areas from negative to positive, and thus preventing them from transferring onto the biased substrate on the separator roll along with the negative toner of the image areas. The resulting image on the biased substrate was a high quality toner while leaving a small amount residual toner on the photoreceptor.

After the final toner image is created as above, (either on the surface of the photoreceptor 10 or on the surface of the separator 20), it may then be transferred to a copy substrate 70 via any means known in the art, which may include an electrostatic transfer apparatus including a corona generating device of the type previously described or a biased transfer roll. Alternatively, a pressure transfer system may be employed which may include a heating and/or chemical application device for assisting in the pressure transfer and fixing of the final toner image on the output copy substrate 70. In yet another alternative, image transfer can be accomplished via surface energy differentials wherein the surface energy between the image and the member supporting the image prior to transfer is lower than the surface energy between the image and the substrate 70, inducing transfer thereto.

In a preferred embodiment, as shown in FIG. 1, the final toner image is transferred to a copy substrate via a heated pressure roll, whereby pressure and heat are simultaneously applied to the image to simultaneously transfer and fuse the image to the copy substrate 70. It will be understood that separate transfer and fusing systems may be provided, wherein the fusing or so-called fixing system may operate using heat (by any means such as radiation, convection, conduction, induction, etc.), or other known fixation process which may include the introduction of a chemical fixing agent.

Figure 6:
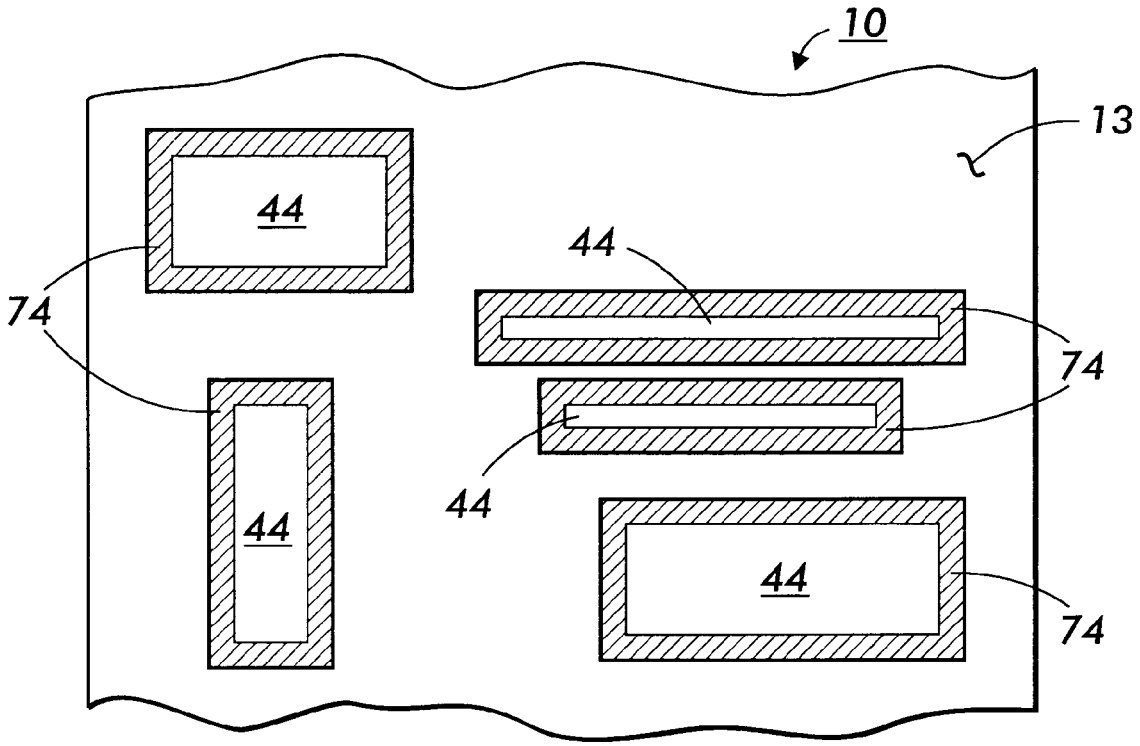
FIG. 6 is an illustration of significantly reduced or diminished toner residue left of each scattered image area centered patch of toner on the surface of the photoreceptor of the machine of FIG. 1, following image formation and transfer in accordance with the present invention.

As can be seen, there has been provided an efficient and high quality image forming method and apparatus in which the quantity or volume of non-development or unused charged toner solids 74' that are applied to the photoreceptor and moved through the development nip is significantly reduced or diminished. FIG. 6 is an illustration of significantly reduced or diminished non-development or waste toner 74' left of each scattered image area centered patch of toner 58 on the surface of the photoreceptor 10 following image formation and transfer in accordance with the present invention. Accordingly, undesirable effects of such non-development charged toner on other charge sensitive machine elements are minimized, and subsequent removal or cleaning of such waste toner from the photoreceptor 10 in order to ready the photoreceptor for recharging and reuse, is also made easy and less costly.

It is, therefore, evident that there has been provided, in accordance with the present invention efficient, high quality liquid toner image producing method and apparatus that fully satisfy the aspects of the invention hereinbefore set forth. While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. An efficient electrostatographic image forming method wherein a quantity of non-development toner applied to a photoreceptor is significantly diminished, the method comprising the steps of:

(a) selectively charging only scattered portions of a surface of the photoreceptor using a first charging device;

(b) applying a coat of charged toner solids having a single polarity onto each charged selected scattered portion, thereby forming an image area patch of toner;

(c) image-wise exposing said image area patch of toner to form a latent image therein;

(d) processing each said image area patch of toner using an air breakdown charging assembly including a relatively large magnitude voltage biasing source and a nip forming roll coupled thereto, for image-wise recharging of said toner solids forming each said image area patch of toner, the air breakdown charging assembly inducing an air breakdown electrical discharge wherein free mobile ions are introduced into a vicinity of each said image area patch of toner, and the latent image underlying each said image area patch of toner cooperating with the large magnitude voltage biasing source to cause said free mobile ions to flow to said toner solids of each said image patch of toner in an image-wise manner, thereby image-wise recharging said toner solids such that said toner solids in image areas of said image patch of toner then have a first polarity, and said toner solids in background areas thereof then have a second and opposite polarity; and (e) separating the image area toner solids having the first polarity from the background area toner solids having the second and opposite polarity, and transferring the image area toner solids onto a copy substrate, thereby resulting in an efficiently produced, quality toner image with significantly reduced non-development toner generated and requiring removal.

2. The method of claim 1, wherein said selectively charging step comprises selectively charging said scattered portions that are each centered relative to an area of the surface of the photoreceptor to be imaged.

3. The method of claim 1, wherein said selectively charging step comprises selectively charging said scattered portions that are each centered relative to an area of the surface of the photoreceptor to be imaged, and wherein each said selected charged scattered portion slightly exceeds the area to be imaged.

4. A liquid immersion development (LID) machine for efficiently forming toner images such that a quantity of unused toner applied to a photoreceptor of the LID machine is significantly diminished, the LID machine comprising:

(a) a movable photoreceptor having a photoconductive surface for supporting electrostatic charge and a toner image;

(b) a first charging device for selectively charging only scattered portions of said surface of said photoreceptor, wherein each selected scattered portion is centered relative to, and has an area slightly exceeding, an area of said surface to be imaged;

(c) an exposure device for image-wise exposing each charged selected scattered portion to form a latent image;

(d) a liquid developer material supply and application apparatus for applying a coat of charged toner solids having a single polarity onto said latent image of each said charged selected scattered portion, thereby forming an image area centered patch of toner;

(e) an air breakdown charge development (ABCD) assembly for developing each said image area centered patch of toner, said air breakdown assembly including a relatively large magnitude voltage biasing source and a nip forming roll coupled thereto, for image-wise recharging of said toner solids forming each said image area centered patch of toner, the air breakdown charging assembly inducing an air breakdown electrical discharge wherein free mobile ions are introduced into a vicinity of each said image area centered patch of toner, and the latent image underlying each image said area centered patch of toner cooperating with the large magnitude voltage biasing source to cause said free mobile ions to flow to said toner solids coating said image area centered patch of toner in an image-wise manner, thereby image-wise recharging said toner solids such that said toner solids in said image areas of each said image area centered patch of toner then have a first polarity, and said toner solids in background areas thereof then have a second and opposite polarity; and (f) a biased separator member for separating the toner solids in said image areas from the toner solids in said background areas, thereby resulting in an efficiently produced, quality toner image with significantly reduced non-development marking material generated and requiring removal.

5. The printing machine of claim 4, wherein said large magnitude voltage biasing source has a polarity that is the same as that of said single polarity toner solids of said liquid developer material.

6. The printing machine of claim 4, wherein said large magnitude voltage biasing source is sufficiently large relative and opposite to a polarity of said background areas of said latent image of each said image area centered patch of toner so as to cause air breakdown between said ABCD assembly and said background areas of each said image area centered patch of toner.

7. The printing machine of claim 6, wherein said air breakdown between said ABCD assembly and said background areas of each said image area centered patch of toner occurs at an entrance of a toner solids recharged nip formed between the ABCD and sad nip forming roll as said background areas of each said image area centered patch of toner enters said toner solids recharging nip.

8. The printing machine of claim 7, wherein said air breakdown between said ABCD assembly and said background areas of each said image area centered patch of toner reverses a charge polarity of unwanted toner solids in said background areas.

* * * * *